US006196593B1

(12) United States Patent
Petrick et al.

(10) Patent No.: US 6,196,593 B1
(45) Date of Patent: Mar. 6, 2001

(54) INTEGRITY SEAL FORM/LABEL COMBINATION FOR ROBOTICS SYSTEMS

(75) Inventors: Kathryn D. Petrick, Chunhassen, MN (US); Cliff J. Post; Michael C. Maier, both of East Amherst, NY (US); Richard L. Moor, Angola, IN (US)

(73) Assignee: Moore U.S.A., Inc., Grand Island, NY (US)

( * ) Notice: Subject to any disclaimer, the term of this patent is extended or adjusted under 35 U.S.C. 154(b) by 0 days.

(21) Appl. No.: 09/102,879

(22) Filed: Jun. 24, 1998

(51) Int. Cl.[7] ..... B42D 15/00

(52) U.S. Cl. ..... 283/81; 283/79; 283/80; 283/101; 40/306; 40/310; 40/316; 40/324

(58) Field of Search ..... 283/79, 80, 81, 283/101; 40/306, 310, 316, 324, 330

(56) References Cited

U.S. PATENT DOCUMENTS

| | | | | |
|---|---|---|---|---|
| 658,422 | | 9/1900 | Braly . | |
| 1,987,902 | * | 1/1935 | Hofe | 283/81 |
| 1,994,961 | * | 3/1935 | Proskauer | 40/306 |
| 2,007,685 | * | 7/1935 | Lyle | 40/4 |
| 4,372,681 | * | 2/1983 | Sallenbach | 356/72 |
| 4,921,277 | | 5/1990 | McDonough . | |
| 4,938,390 | | 7/1990 | Markva . | |
| 4,976,351 | | 12/1990 | Mangini et al. . | |
| 5,000,484 | | 3/1991 | Phelan et al. . | |
| 5,243,173 | | 9/1993 | Dunn . | |
| 5,423,573 | | 6/1995 | de Passille . | |
| 5,642,906 | | 7/1997 | Foote et al. . | |
| 5,702,128 | * | 12/1997 | Maxim et al. | 283/81 |

* cited by examiner

*Primary Examiner*—Stephen F. Gerrity
*Assistant Examiner*—Daniel Phan
(74) *Attorney, Agent, or Firm*—Nixon & Vanderhye P.C.

(57) ABSTRACT

A specimen container label is particularly suited for use by robotic elements to improve the tedious process of aliquoting urine samples to increase productivity and decrease costs in laboratories. The label has a substrate with top and bottom surfaces and pressure sensitive adhesive provided on the bottom surface to effectively secure the label to a specimen container. The substrate also includes a central enlarged, preferably circular in plan, portion, with at least one wing, typically two opposite wings, extending outwardly from the central enlarged portion, and an opening in the substrate at the central portion which allows a robotic element to handle a specimen container cover over which the substrate central portion is applied. The opening may be covered with a glassine patch, which is easily pierced by the robotic element. The label may initially be provided with a release liner of the same dimensions and configuration, and the wings may be necked down where they engage the central portion. The label substrate may be provided on a business form with other labels, typically all having the same bar code indicia on them.

12 Claims, 5 Drawing Sheets

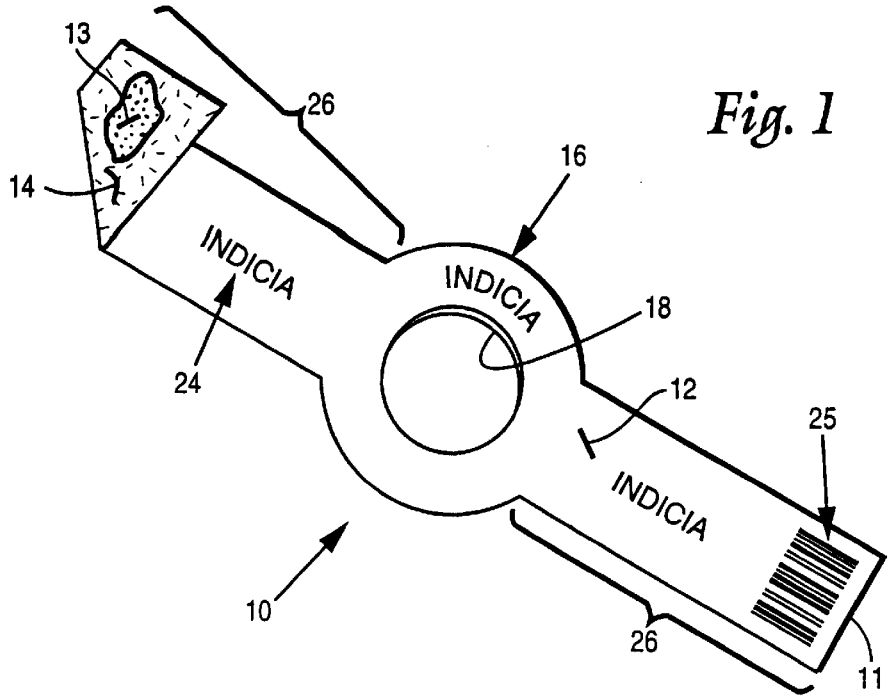
Fig. 1
Fig. 2
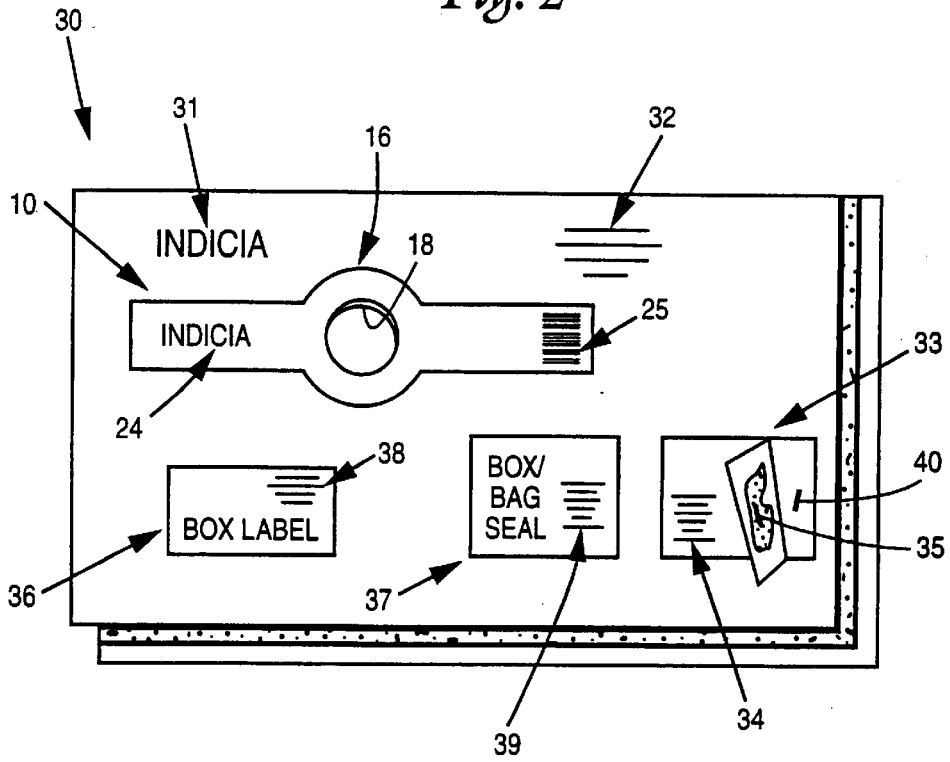

*Fig. 3*
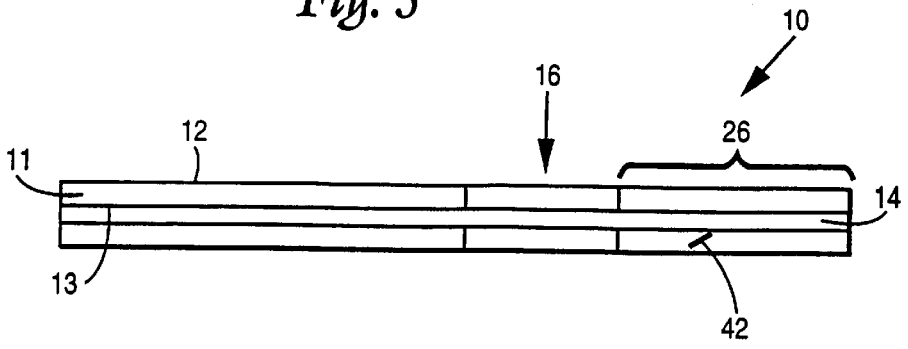
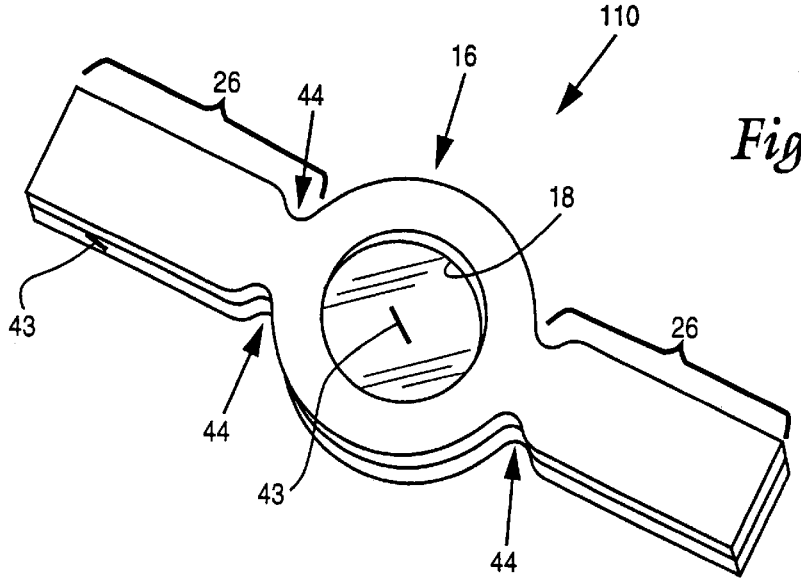
*Fig. 4*
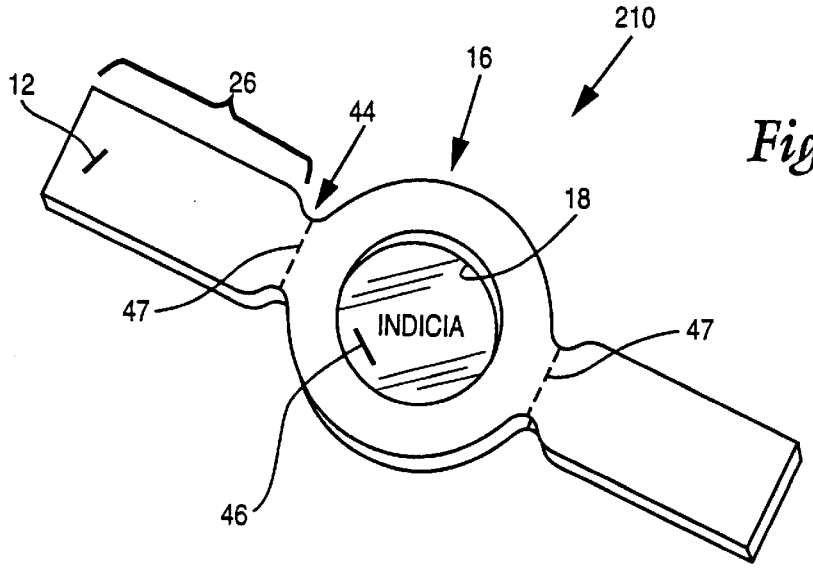
*Fig. 5*

INTEGRITY SEAL FORM/LABEL COMBINATION FOR ROBOTICS SYSTEMS

BACKGROUND AND SUMMARY OF THE INVENTION

Society is increasingly becoming concerned with testing of bodily fluids for a number of purposes, such as testing urine samples for drug use, for health indicators, and the like. It is normally a tedious process to aliquot urine samples manually, and it has long been the goal of laboratories, particularly drug testing laboratories, to improve productivity and decrease costs in the handling of urine samples. It is also very important to be able to handle the urine samples without mistake, and to be able to determine whether a urine sample has been tampered with. Therefore some sort of tamper indicating label is provided on the specimen container, the label performing the tamper indicating function as well as providing indicia, such as machine readable indicia like bar coding, to allow effective tracking of the urine specimen.

Robotic elements can be used to automate tedious manual procedures, however when dealing with specimen containers, it is often difficult for the robotic elements to properly handle the containers especially since the tamper indicating and tracking-facilitating labels may interfere with the robotic elements. This may cause interruptions in processing, and potentially damage to the specimen containers or the integrity of the system, therefore heretofore it has been difficult to effectively automate aliquoting of urine samples utilizing robotic elements.

According to the present invention, a specimen container label, a specimen container, and a method of handling a specimen container, are provided which allow automation of laboratory handling of specimens, including improving the productivity and decreasing the costs of aliquoting urine samples, particularly for drug testing laboratories. The labeling system and procedure according to the present invention allows for effective engagement of the urine specimens with a robotic element while still effectively performing the functions of tamper indication and tracking. The particularly designed label according to the present invention is used with other conventional labels, such as main sample labels, sample B labels, and box/bag seal labels, for effective tracking, labeling, etc., of urine specimens, and may increase the productivity of aliquoting urine samples from about 30 per hour (when done manually) to about 300 per hour (when done automatically using robotic elements).

The labeling system according to the present invention is easy to use at collection sites, that is the labeling system can be used by relatively poorly trained or untrained personnel. The system according to the invention does not differ too significantly from present procedures, which makes its implementation far more practical and expeditious. The labeling system is particularly compatible with the SPS Robotics System, and keeps the robotic arm free of adhesive, and minimizes the label waste. The system according to the invention also provides maximum flexibility with respect to numbering and bar coding, and may be printed on press, or on site by the customer. The label material utilized according to the invention can securely adhere to the specimen container within a minute, has lightweight face stock and an aggressive adhesive to maximize tamper evidency, and will maintain adhesion even if the samples get wet. The label maintains its tamper evident functions even in a wide range of temperatures, e.g. from −40–180° F., and has a long life (typically over five years). The label may also be used with various security features such as serrated edges, interlocking security circles, hash cuts, and the like.

According to one aspect of the present invention a specimen container label is provided comprising the following components: A label substrate having a top surface and a bottom surface. Pressure sensitive adhesive provided over a sufficient area of the bottom surface to effectively secure the label substrate to a specimen container. The substrate including a central enlarged portion, with at least one wing extending outwardly from the central enlarged portion. And, an opening in the substrate at the central portion which allows a robotic element to handle a specimen container cover over which the substrate central portion is applied.

The specimen container label according to the invention also preferably has the following additional features: The at least one wing comprises at least two wings. The central enlarged portion is substantially circular in plan, and the opening is also substantially circular in plan. The label further comprises indicia, including machine readable indicia (e.g. bar coding), on the label substrate top surface. The label further comprises a release liner having substantially the same shape and dimensions as the label substrate, and covering the pressure sensitive adhesive, and readily removable from the pressure sensitive adhesive to expose the adhesive. The label further comprises a patch engaging the bottom surface of the label substrate and closing the opening in the substrate, the patch of material (e.g. glassine) that may be much more readily punctured by robotic element than the label substrate. And, the label may further comprise machine readable indicia on the top surface; and the label substrate is releasably mounted on a business form containing at least one other label having the same machine readable indicia thereon.

According to another aspect of the present invention a specimen container is provided comprising the following components: A body having an open top. A cover for the body open top, including a portion thereof for handling by a robotic element. And, a label holding the cover on the body in a predetermined position so that breaking of the label indicates that the cover may have been opened, the label comprising a central enlarged portion engaging the cover, with at least one wing extending outwardly from the central enlarged portion and engaging the body; and an opening in the label at the central portion which allows a robotic element to handle the cover, the central portion and the at least one wing at least in part held to the cover and body by pressure sensitive adhesive.

The specimen container body, cap, and label may have further particulars as follows: The body comprises a vial and the cover comprises a screw on cap having a top surface having a substantially circular peripheral portion, an annular opening adjacent the peripheral portion, and a central substantially cylindrical portion, the opening in the label central enlarged portion overlying the cap central substantially cylindrical portion. The label central enlarged portion is substantially circular in plan, having substantially the same diameter as the vial cap. The label has visible machine readable indicia on at least one of the central portion and the wing. The at least one wing comprises at least two wings engaging the body on substantially opposite sides of the central portion. And, the label may further comprise a patch engaging the bottom surface of the label and closing the opening in the substrate, the patch of material that may be much more readily punctured by robotic element than the label substrate.

According to another aspect of the present invention a method of handling a specimen container comprising a body with an open top covered by a cover, the body having a specimen therein, using a label having an enlarged central portion and at least one wing with top and bottom faces and pressure sensitive adhesive on the bottom face of each, and an opening in the central portion, is provided. The method comprises: (a) Placing the central portion of the label on the specimen container cover, and the at least one wing on the specimen container body, so that the pressure sensitive adhesive holds the cover to the body in a manner that will indicate tampering. (b) Shipping the specimen container to a laboratory without disturbing the label in a way that indicates tampering. (c) Engaging the cover with a robotic element by moving the robotic element through the opening in the label into contact with the cover. And, (d) aliquoting the specimen container using the robotic element.

The method acts may be further practiced as indicated by the following: Where the specimen container comprises a vial, and the cover for the specimen container comprises a screw threaded cap for covering the vial, then (d) is practiced in part by twisting the screw on cap with the robotic element to unscrew the cap, and break the seal provided by the label. Where the opening in the label is covered by a glassine patch, and then (c) is practiced by the robotic element piercing the glassine patch to engage the cap. Where the cap for the vial has a peripheral ring, an annular space adjacent the peripheral ring, and a central substantially cylindrical upstanding portion, then (c) is practiced to move the robotic element through the opening to grasp the substantially cylindrical upstanding portion.

It is the primary object of the present invention to provide a simple yet effective specimen container label system that facilitates automation of specimen container handling, will not adversely impact labeling at the collection site, and will not interfere with other intended functions of the labeling system. This and other objects of the invention will become clear from an inspection of the detailed description of the invention and from the appended claims.

BRIEF DESCRIPTION OF THE DRAWINGS

FIG. 1 is a top perspective view of a first embodiment of an exemplary specimen container label according to the present invention, with one corner turned back to illustrate the bottom surface;

FIG. 2 is a top schematic view of the label of FIG. 1 shown on a business form in association with other labels and business form elements;

FIG. 3 is a side schematic view, with the elements greatly enlarged for clarity of illustration, of the label of FIG. 1 and in contact with a release liner;

FIG. 4 is a view like that of FIG. 1 only showing an embodiment in which necked down portions are provided and a release liner of the same configuration and size as the label is provided with the label;

FIG. 5 is a view like that of FIG. 1 of another embodiment of a specimen container label according to the invention;

DETAILED DESCRIPTION OF THE DRAWINGS

Figure 6:
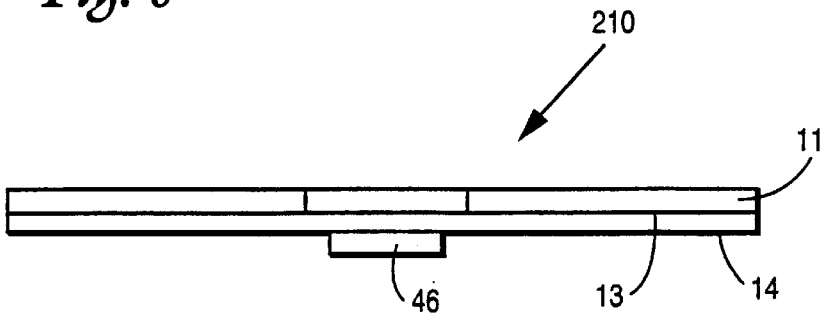
FIG. 6 is a side schematic view, with the components greatly enlarged for clarity of illustration, of the embodiment of FIG. 5.

One embodiment of a specimen container label according to the present invention is shown schematically and generally by reference numeral 10 in FIGS. 1 through 3. The label 10 includes a label substrate 11 (see FIG. 3) of any conventional label material suitable for specimen containers, typically of tear-resistant paper, or plastic. The substrate 11 has a top surface 12 and a bottom surface 13. Pressure sensitive adhesive 14 (illustrated greatly exaggerated in thickness in FIG. 3) is provided on the bottom surface 14. While preferably the adhesive 14 covers virtually the entire bottom surface 13, it is only necessary that enough adhesive 14 be provided over a sufficient area of the bottom 13 to effectively secure the label substrate 11 to a specimen container, such as the container illustrated generally by reference numeral 15 in FIG. 8. The pressure sensitive adhesive 14 is preferably an aggressive adhesive, such as SWIFT 84468.

The substrate 11 also includes a central enlarged portion 16, the shape in plan of the central enlarged portion 16 typically corresponding to the shape of a cover of a specimen container with which it will be utilized. Since most specimen containers have caps—such as the cap 17 illustrated in FIGS. 8 through 10—that is circular, the enlarged central portion 16 is typically circular having an outside diameter approximately the same as the cap 17 with which it will be used. In the central portion an opening 18 is provided. The opening 18 is dimensioned and configured so as to allow a robotic element—such as illustrated schematically at 19 in FIG. 8 (such as part of the SPS Robotics System)—to pass through the opening 18 into operative association with the cap 17 to handle the specimen container cap 17. Where the cap is like the cap 17 illustrated in FIGS. 8 through 10, having a ring shaped periphery 20 with an annular gap 21 adjacent the periphery 20, and a central substantially cylindrical upstanding portion 22, the diameter of the opening 18 is slightly greater than that of the cylindrical cap portion 22.

The top surface 12 also preferably has indicia, such as illustrated schematically at 24 in FIGS. 1 and 2, associated therewith as well as machine readable indicia, such as the bar coding 25 illustrated in FIGS. 1 and 2. The indicia 24, 25 may be provided on the enlarged central portion 16, and/or on one or more wings 26 that are preferably integral with and extend radially outwardly from the central portion 16. In the preferred embodiment, in order to minimize waste, but to ensure proper tamper evidency and tracking, it is desirable to provide two wings 26 extending outwardly from substantially opposite sides of the central portion 16.

While the dimensions of the label 10 will depend in large part upon the container 15 being utilized, in one exemplary embodiment each wing 26 may have a length of two to three inches, and the central portion 16 an other diameter of about 1.5–2.5 inches, with the diameter of the opening 18 of about 0.5–1.5 inches. For example the total length of the label 10 from the end of one wing 26 to the end of the other wing 26 may be about eight inches, the outer diameter of the central portion about 2¼ inches, and the diameter of the opening 18 about 1¼ inches. In any event the wings 26 are long enough to engage and adhere to the side wall of the specimen container 15, as illustrated schematically in FIG. 8.

Typically the label 10 is one component of a business form, shown schematically at 30 in FIG. 2, which is provided for drug testing. The form 30 may be a single part form, or a multiple part (e.g. 7 part) form, with carbonless coatings provided on the various plies, etc., to effect transfer of indicia imprinted on the top sheet of the business form 30 to one or more underlying sheets. Any conventional or suitable business form 30 may be utilized in association with the label 10. FIG. 2 merely has a schematic representation of one such business form 30, which includes indicia 31 that is human readable, as well as bar coding 32 or like machine readable indicia, thereon. The indicia 32 preferably corresponds to the indicia 25 to provide a tracking function. Also the form 30 includes at least one other label, such as the label illustrated 25 schematically at 33 being peeled away from the release liner substrate 40, which has bar coding 34 comparable to the bar coding 25, the label 33 for placement on the container 15, as illustrated schematically in FIG. 8. The label 33 also has a bottom surface with pressure sensitive adhesive 35 thereon. Other labels, such as B-Label 36, and a box/bag seal label 37, also may be provided, these labels also preferably having the same tracking indicia 38, 39 as the indicia 25, 32, 34.

In the embodiment illustrated in FIG. 2, the top ply of the form is illustrated as having a release liner 40 at the bottom thereof. That is all of the labels 10, 33, 36, and 37 may be peeled away from the release liner 40, the adhesive—such as the adhesive 14, 35—sticking to the bottom of the label substrate and releasing from the release liner 40. Alternatively one or more of the labels 10, 33, 36, 37 may be blown on to the form 30, and have its own self-contained release liner, such as the release liner illustrated at 42 in FIG. 3 and at 43 in FIG. 4. That is the label 10 may be a self-contained label readily removed from the form 30 but yet not having the adhesive 14 exposed until the release liner 42 is removed.

FIG. 4 shows an embodiment like that of FIGS. 1 and 3, with the release liner 43, the release liner 43 being visible through the opening 18. In the FIG. 4 embodiment components comparable to those in FIG. 1 are shown by the same reference numeral. The indicia 24, 25, etc. is not shown for the label 110 of FIG. 4 only for simplicity of illustration.

The label 110 includes necked down or thinned portions 44 of the wings 26 where the wings 26 are connected to the central portion 16. The thinned portions 44 facilitate tearing of the label 110 to allow opening of the specimen container 15 when ultimately desired, while still providing a secure label that will not easily inadvertently be tom or otherwise breached.

FIG. 5 illustrates another exemplary label 210 according to the invention. Components of the label 210 that are the same as those of the labels 10 and 110 are shown by the same reference numeral. The only difference between the label 210 and the label 110 (the label 210 not being shown in association with a release liner 43) is the provision of a patch 46 at the bottom surface 13 of the substrate 11 which covers the opening 18. The patch 46 is of the thin and/or readily punctured material so that it does not significantly interfere with the passage of the robotic element, illustrated schematically at 19 in FIG. 8, therethrough. For example the patch 46 may be a conventional glassine patch such as used in conventional mailed window envelopes. However other materials may also be suitable, and various lines of weakness, such as score lines, etc., or perforation lines, may be provided in the patch 46 to facilitate its breach by the robotic element 19. Also this embodiment shows lines of weakness 47 at the thinned down portions 44, to facilitate separation of the label 210 thereat.

Figure 7:
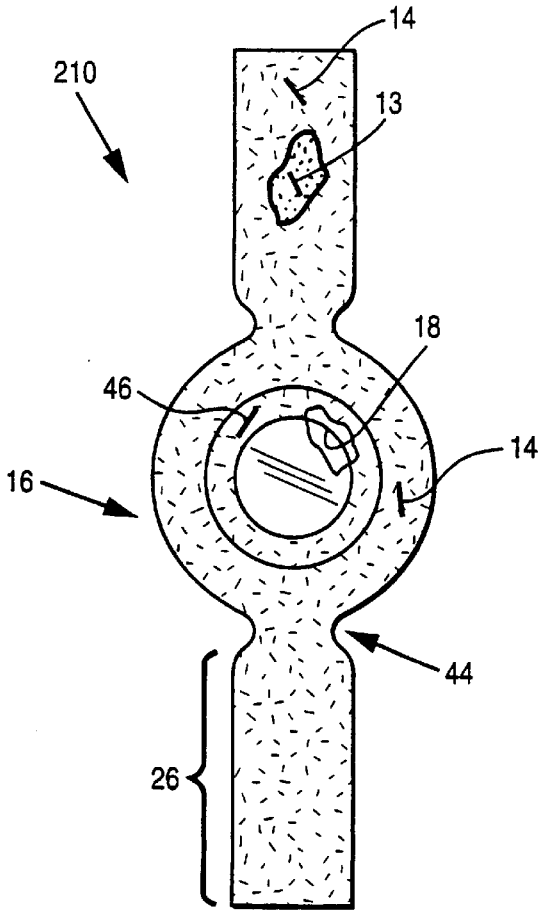
FIG. 7 is a bottom plan view of the embodiment of FIGS. 5 and 6.

The patch 46 may be held to the bottom 13 of the label 210 with the pressure sensitive adhesive 14, or a special adhesive may be provided for that purpose. As seen in FIG. 7, preferably the patch 46 does not cover all of the adhesive 14 on the enlarged central portion 16, so that part of the adhesive 14 on the enlarged central portion 16 can engage the peripheral ring 20 of the specimen container cap 17 (or any like suitable structure).

The labels 10, 110, 210 may also be constructed so as to have various conventional or desirable security features such as serrated edges, interlocking security circles, hash cuts, or the like, such as shown in copending application Ser. No. 08/864,739 filed May 28, 1997 (Attorney Docket 263-1634, 9735 US), the disclosure of which is hereby incorporated by reference herein, and the art cited therein.

Figure 8:
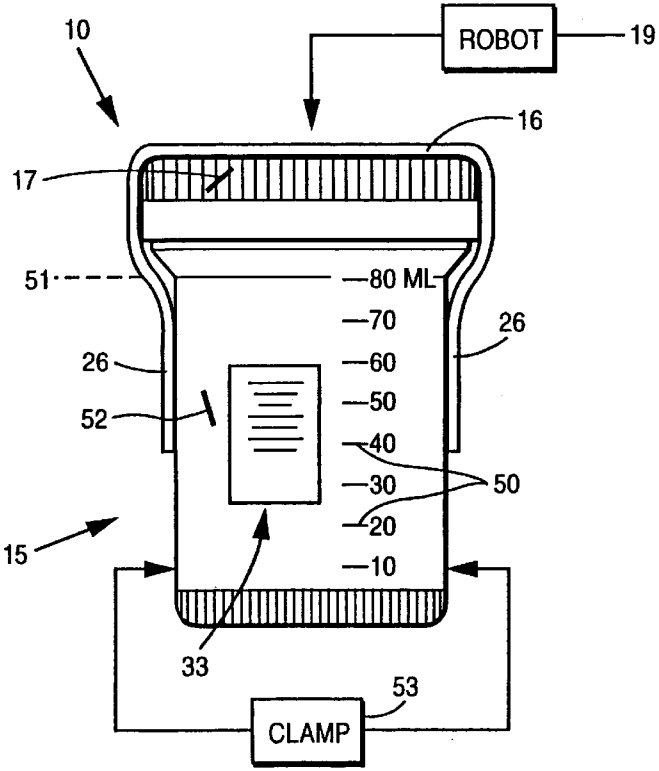
FIG. 8 is a side schematic view of a specimen container according to the present invention having the label of FIG. 1 associated therewith, and shown in schematic association with the robotic system.

The specimen container 15 illustrated in FIG. 8 is a conventional transparent plastic vial such as typically used in urine specimens, especially for drug testing, which may have the graduations 50 provided thereon to indicate the volume of urine (the level of which is indicated at 51 in FIG. 8) provided therein. The label 10 is shown placed in operative association therewith by causing the adhesive 14 on the bottom of the central enlarged portion 16 of the label 10 to engage the cap 17 peripheral ring 20, while wings 26 extend downwardly into contact with the continuous side wall 52 of the container 15, the adhesive 14 holding both of the wings 26 tightly in contact with the side wall 52. The cap 17 is a conventional screw on cap in the preferred embodiment, although other connections of the cap 17 to the container 15 may be provided, and the robotic element 19 adjusted accordingly.

In order to facilitate removal of the cap 17 from the vial 15 in an automated basis, in addition to the robotic element 19 some sort of automatic clamping mechanism—of any conventional construction for this purpose—may be provided for holding the bottom of the vial 15, as illustrated schematically at 53 in FIG. 8.

Figure 11:
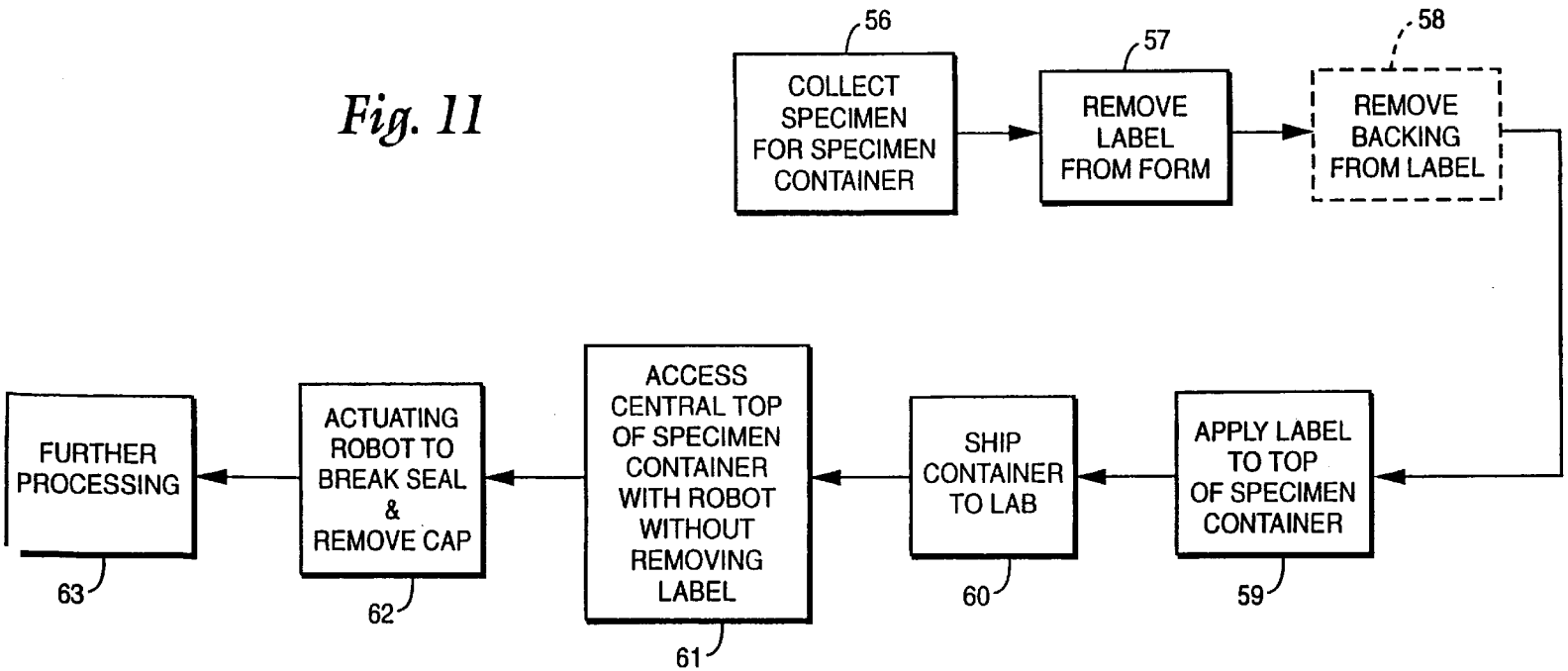
FIG. 11 is a schematic box diagram illustrating the various method acts that may be practiced in the utilization of the structures of FIGS. 1 through 10 to practice the method according to the invention.

FIG. 11 schematically illustrates the exemplary method steps that are practiced according to one embodiment of the invention.

Figure 9:
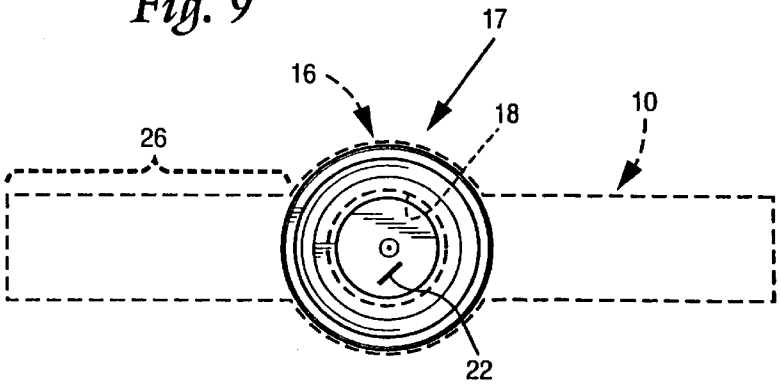
FIG. 9 is a top plan view of the cap of the specimen container of FIG. 8, showing the label of FIG. 1 in dotted line as initially brought into operate association therewith.
Figure 10:
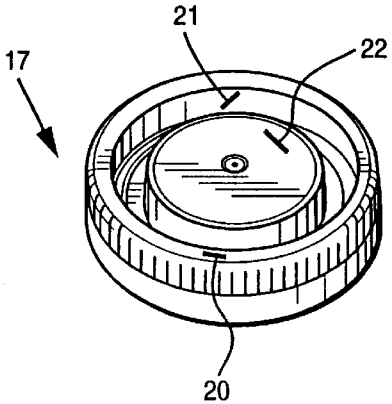
FIG. 10 is a top perspective view of the cap of FIG. 9.

The box 56 illustrates the conventional collection of specimens for the specimen container 15, typically urine. The collection is done in an entirely conventional manner. The label 10 is removed from the form 30, as indicated by box 57 in FIG. 11, and if the label is like the label 110 having a self-contained release liner, then the release liner 43 is removed from the label 110, as schematically illustrated at 58 in FIG. 11. Then the label 10, 110, 210 is applied to the cap 17 of the vial 15, as indicated schematically at 59 in FIG. 11. This is done, as illustrated in FIGS. 8 and 9, by placing that part of the enlarged central portion 16 of the label 10 exteriorly outwardly of the opening 18 into contact with the peripheral ring 20 of the cap 17, while the cylindrical projection 22 of the cap 17 remains uncovered and accessible to the robotic element 19. The wings 26 are bent down into contact with the continuous side wall 52 of the container 15, providing tamper evident sealing of the cap 17 to the vial 15 as illustrated schematically in FIG. 8.

The label 33, and various other labels as are necessary, are provided on the container 15 or any other associated structures in order to provide proper tracking of the container 15, as is conventional.

After proper collection and labeling of the specimen container 15, it is shipped to the testing laboratory, as indicated schematically at 60 in FIG. 11. At the testing laboratory the robotic element 19 is moved into operative association with the cap 17, such as passing through the opening 18 to grasp the central cylindrical portion 22, without requiring manual other removal of the label 10, as illustrated schematically at 61 in FIG. 11. Then the robotic element 19 is actuated, as indicated schematically at 62 in FIG. 8, and typically with the clamp 53 engaged, to break the seal provided by the label 10 (that is at the interface between the wings 26 and the central portion 16; at the necked down portions 44 of the labels 110, 210). For example this is done by causing the robotic element 19 to rotate, which rotates and unscrews cap 17 from the vial 15. Once the cap 17 is removed, the vial 15 contents are further processed, as indicated schematically at 63 in FIG. 11, as is conventional and/or using appropriate robotic equipment.

It will thus be seen that according to the present invention a simple yet effective specimen container label, specimen container, and method of handling the specimen container, have been provided particularly which facilitate automation of urine samples aliquoting. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A specimen container label comprising:

a label substrate having a top surface and a bottom surface;

pressure sensitive adhesive provided over a sufficient area of said bottom surface to effectively secure said label substrate to a specimen container;

said substrate including a central enlarged portion, with at least one wing extending outwardly from said central enlarged portion;

an opening in said substrate at said central portion which allows a robotic element to handle a specimen container cover over which said substrate central portion is applied; and a patch engaging said bottom surface of said label substrate and closing said opening in said substrate, said patch of material that may be much more readily punctured by a robotic element than said label substrate.

2. A specimen container label as recited in claim 1 wherein said at least one wing comprises at least two wings.

3. A specimen container label as recited in claim 2 wherein said central enlarged portion is substantially circular in plan, and wherein said opening is also substantially circular in plan.

4. A specimen container label as recited in claim 1 wherein said central enlarged portion is substantially circular in plan, and wherein said opening is also substantially circular in plan.

5. A specimen container label as recited in claim 1 wherein said patch comprises a glassine patch.

6. A specimen container label as recited in claim 1 further comprising machine readable indicia on said top surface; and wherein said label substrate is releasably mounted on a business form containing at least one other label of a different construction but having the same machine readable indicia thereon.

7. A specimen container label comprising:

a label substrate having a top surface and a bottom surface;

pressure sensitive adhesive provided over a sufficient area of said bottom surface to effectively secure said label substrate to specimen container;

said substrate including a central enlarged portion, with at least one wing extending outwardly from said central enlarged portion;

an opening in said substrate at said central portion which allows a robotic element to handle a specimen container cover over which said substrate central portion is applied;

wherein said central enlarged portion is substantially circular in plan, and wherein said opening is also substantially circular in plan; and further comprising a patch engaging said bottom surface of said label substrate and closing said opening in said substrate, said patch of material that may be much more readily punctured by a robotic element than said label substrate.

8. A specimen container label as recited in claim 7 further comprising indicia, including machine readable indicia, on said label substrate top surface.

9. A specimen container label as recited in claim 8 further comprising a release liner having substantially the same shape and dimensions as said label substrate, and covering said pressure sensitive adhesive, and readily removable from said pressure sensitive adhesive to expose said adhesive.

10. A specimen container label as recited in claim 7 further comprising a release liner having substantially the same shape and dimensions as said label substrate, and covering said pressure sensitive adhesive, and readily removable from said pressure sensitive adhesive to expose said adhesive.

11. A specimen container label as recited in claim 10 wherein said at least one wing comprises at least two wings.

12. A specimen container label comprising:

a label substrate having a top surface and a bottom surface;

pressure sensitive adhesive provided over a sufficient area of said bottom surface to effectively secure said label substrate to a specimen container;

said substrate including a central enlarged portion, with at least one wing extending outwardly from said central enlarged portion;

an opening in said substrate at said central portion which allows a robotic element to handle a specimen container cover over which said substrate central portion is applied;

machine readable indicia on said top surface; and wherein said label substrate is releasably mounted on a business form containing at least one other label of a different construction but having the same machine readable indicia thereon.

* * * * *